US011957169B2

(12) United States Patent
Potter et al.

(10) Patent No.: US 11,957,169 B2
(45) Date of Patent: Apr. 16, 2024

(54) VAPOR PROVISION APPARATUS AND SYSTEMS

(71) Applicant: NICOVENTURES TRADING LIMITED, London (GB)

(72) Inventors: Mark Potter, London (GB); Wade Tipton, London (GB); William Harris, London (GB); Christopher Rowe, London (GB); James Davies, London (GB); James Boonzaier, London (GB); Conor Devine, London (GB)

(73) Assignee: NICOVENTURES TRADING LIMITED, London (GB)

( * ) Notice: Subject to any disclaimer, the term of this patent is extended or adjusted under 35 U.S.C. 154(b) by 936 days.

(21) Appl. No.: 15/733,415

(22) PCT Filed: Jan. 8, 2019

(86) PCT No.: PCT/GB2019/050037
§ 371 (c)(1),
(2) Date: Jul. 23, 2020

(87) PCT Pub. No.: WO2019/145672
PCT Pub. Date: Aug. 1, 2019

(65) Prior Publication Data

US 2020/0345069 A1 Nov. 5, 2020

(30) Foreign Application Priority Data

Jan. 24, 2018 (GB) ..... 1801143

(51) Int. Cl.
*A24F 40/44* (2020.01)
*A24F 40/42* (2020.01)
(Continued)

(52) U.S. Cl.
CPC ..... *A24F 40/44* (2020.01); *A24F 40/42* (2020.01); *A24F 40/46* (2020.01); *A24F 40/485* (2020.01);
(Continued)

(58) Field of Classification Search
CPC ..... A24F 40/44; A24F 40/42; A24F 40/46; A24F 40/485; A24F 40/10; A24F 40/50;
(Continued)

(56) References Cited

U.S. PATENT DOCUMENTS 8,061,361 B2 11/2011 Maeder et al.
9,254,007 B2 2/2016 Liu
(Continued)

FOREIGN PATENT DOCUMENTS

CN 201781984 U 4/2011
CN 201830900 U 5/2011
(Continued)

OTHER PUBLICATIONS

Communication pursuant to Article 94(3) EPC for Application No. 18715070.1, dated Nov. 2, 2020, 21 pages.
(Continued)

*Primary Examiner* — Travis S Chambers
(74) *Attorney, Agent, or Firm* — Husch Blackwell LLP

(57) ABSTRACT

Vapor provision apparatus including a reservoir housing defining a reservoir for liquid, a liquid transport element for transporting liquid from the reservoir to a vaporizer for vaporization and a channel for the liquid transport element, wherein the channel has a sidewall at least partly defined by a section of the reservoir housing; wherein the liquid transport element comprises a first portion arranged to deliver liquid to the vaporizer and a second portion extending along the channel, wherein the channel has a cross-section that corresponds with the cross-section of the second portion of
(Continued)

the liquid transport element in the channel, and wherein the section of the reservoir housing that defines the sidewall of the channel has one or more openings to provide fluid communication between the liquid transport element in the channel and liquid in the reservoir.

20 Claims, 4 Drawing Sheets

(51) Int. Cl.
*A24F 40/46* (2020.01)
*A24F 40/485* (2020.01)
*A24F 40/10* (2020.01)
*A24F 40/50* (2020.01)
*A24F 40/70* (2020.01)

(52) U.S. Cl.
CPC ..... *A24F 40/10* (2020.01); *A24F 40/50* (2020.01); *A24F 40/70* (2020.01)

(58) Field of Classification Search
CPC ..... A24F 40/70; A24F 40/465; A24F 47/00; H05B 6/36
See application file for complete search history.

(56) References Cited

U.S. PATENT DOCUMENTS

| | | | | |
|---|---|---|---|---|
| 10,258,087 | B2 | 4/2019 | Kane | |
| 11,213,638 | B2 | 1/2022 | Netterstrom et al. | |
| 11,388,931 | B2 | 7/2022 | Potter et al. | |
| 2011/0005535 | A1 | 1/2011 | Xiu | |
| 2013/0081642 | A1* | 4/2013 | Safari | A24B 15/16 131/347 |
| 2013/0087160 | A1 | 4/2013 | Gherghe | |
| 2013/0228191 | A1 | 9/2013 | Newton | |
| 2013/0263869 | A1 | 10/2013 | Zhu | |
| 2013/0306065 | A1 | 11/2013 | Thorens et al. | |
| 2014/0123989 | A1 | 5/2014 | Lamothe | |
| 2014/0130816 | A1 | 5/2014 | Liu | |
| 2014/0238423 | A1 | 8/2014 | Tucker et al. | |
| 2014/0238424 | A1 | 8/2014 | Macko et al. | |
| 2015/0040927 | A1 | 2/2015 | Li et al. | |
| 2015/0144145 | A1* | 5/2015 | Chang | A24F 40/44 131/328 |
| 2016/0015081 | A1* | 1/2016 | Liu | H05B 3/16 131/329 |
| 2016/0015082 | A1 | 1/2016 | Liu | |
| 2016/0073692 | A1 | 3/2016 | Alarcon et al. | |
| 2016/0121058 | A1 | 5/2016 | Chen | |
| 2016/0278163 | A1 | 9/2016 | Chen | |
| 2016/0286863 | A1* | 10/2016 | Lin | A24D 3/16 |
| 2016/0345632 | A1 | 12/2016 | Lipowicz | |
| 2017/0042242 | A1 | 2/2017 | Hon | |
| 2017/0127725 | A1* | 5/2017 | Buchberger | A24F 40/44 |
| 2017/0273359 | A1 | 9/2017 | Liu | |
| 2017/0303596 | A1 | 10/2017 | Chen | |
| 2020/0352238 | A1 | 11/2020 | Simpson et al. | |
| 2021/0145055 | A1 | 5/2021 | Potter et al. | |

FOREIGN PATENT DOCUMENTS

| | | | |
|---|---|---|---|
| CN | 103380952 | A | 11/2013 |
| CN | 204120237 | U | 1/2015 |
| CN | 104366695 | A | 2/2015 |
| CN | 104720117 | A | 6/2015 |
| CN | 204426699 | U | 7/2015 |
| CN | 204483035 | U | 7/2015 |
| CN | 105163614 | A | 12/2015 |
| CN | 105188428 | A | 12/2015 |
| CN | 105208882 | A | 12/2015 |
| CN | 105342010 | A | 2/2016 |
| CN | 105433442 | A | 3/2016 |
| CN | 205285008 | U | 6/2016 |
| CN | 205512338 | U | 8/2016 |
| CN | 106376976 | A | 2/2017 |
| CN | 106535682 | A | 3/2017 |
| CN | 206119177 | U | 4/2017 |
| CN | 206197019 | U | 5/2017 |
| CN | 206197020 | U | 5/2017 |
| CN | 107708452 | A | 2/2018 |
| EP | 2460424 | A1 | 6/2012 |
| EP | 2823720 | A1 | 1/2015 |
| EP | 2959784 | A1 | 12/2015 |
| EP | 2984952 | A1 | 2/2016 |
| EP | 3108759 | A1 | 12/2016 |
| GB | 2513639 | A | 11/2014 |
| JP | 2017514504 | A | 6/2017 |
| KR | 20120098343 | A | 9/2012 |
| KR | 20140002774 | U | 5/2014 |
| RU | 2425608 | C2 | 8/2011 |
| RU | 2606572 | C2 | 1/2017 |
| RU | 2620754 | C2 | 5/2017 |
| RU | 2639972 | C2 | 12/2017 |
| WO | WO-2011146375 | A2 | 11/2011 |
| WO | 2016041209 | A1 | 3/2016 |
| WO | WO-2016079151 | A1 | 5/2016 |
| WO | 2016090531 | A1 | 6/2016 |
| WO | WO-2016176800 | A1 | 11/2016 |
| WO | WO-2016190222 | A1 | 12/2016 |
| WO | WO-2016198417 | A1 | 12/2016 |
| WO | WO-2016207357 | A1 | 12/2016 |
| WO | WO-2016208756 | A1 | 12/2016 |
| WO | WO-2017001818 | A1 | 1/2017 |
| WO | WO-2017001819 | A1 | 1/2017 |
| WO | WO-2017015832 | A1 | 2/2017 |
| WO | WO-2017215221 | A1 | 12/2017 |

OTHER PUBLICATIONS

International Preliminary Report on Patentability for Application No. PCT/GB2018/050726, dated Jul. 3, 2019, 32 pages.
International Preliminary Report on Patentability for Application No. PCT/GB2019/050037, dated May 8, 2020, 21 pages.
International Preliminary Report on Patentability for Application No. PCT/GB2019/050186, dated May 8, 2020, 8 pages.
International Preliminary Report on Patentability for Application No. PCT/GB2019/050187 dated Aug. 6, 2020, 8 pages.
International Preliminary Report on Patentability for Application No. PCT/GB2019/050187 dated Jul. 28, 2020, 7 pages.
International Search Report and Written Opinion for Application No. PCT/GB2018/050726, dated Jun. 12, 2018, 15 pages.
International Search Report and Written Opinion for Application No. PCT/GB2019/050037, dated Mar. 25, 2019, 12 pages.
International Search Report for Application No. PCT/GB2019/050187, dated Apr. 18, 2019, 3 pages.
Notice of Reasons for Rejection for Japanese Application No. 2020-539826, dated Jun. 15, 2021, 14 pages.
Office Action for Canadian Application No. 3089292, dated Dec. 16, 2021, 6 pages.
Office Action For Chinese Application No. 201880020522.4, dated Aug. 3, 2021, 14 pages.
Office Action For Chinese Application No. 201880020522.4, dated May 20, 2022, 12 pages.
Office Action for Japanese Patent Application No. 2020-537201, dated Jul. 13, 2021, 5 pages.
Office Action For Korean Application No. 10-2019-7027899, dated Jan. 18, 2021, 17 pages.
Office Action For Korean Application No. 10-2019-7027899, dated Jul. 27, 2021, 15 pages.
Office Action For Russian Application No. 2020124567, dated Jan. 28, 2021, 2 pages.
Search Report for Russian Application No. 2020124379 dated Mar. 2, 2021, 2 pages.
Search Report dated Apr. 27, 2017 for Great Britain Application No. GB1704674.9, 5 pages.
Search Report dated May 31, 2017 for Great Britain Application No. GB1702861.4, 5 pages.

(56) References Cited

OTHER PUBLICATIONS

Second Office Action dated Jan. 20, 2022 for Chinese Application No. 201880020522.4, 17 pages.
"International Search Report and Written Opinion received for PCT Patent Application No. PCT/GB2019/050089, dated Mar. 25, 2019", 10 pages.
"Notice of Allowance received for Korean Patent Application No. 10-2020-7021264, dated Nov. 14, 2022", 6 pages (3 pages of English Translation and 3 pages of Official Copy).
"Office Action received for Chinese Patent Application No. 201980009907.5, dated Nov. 2, 2022", 17 pages (9 pages of English Translation and 8 pages of Official Copy).

* cited by examiner

VAPOR PROVISION APPARATUS AND SYSTEMS

PRIORITY CLAIM

The present application is a National Phase entry of PCT Application No. PCT/GB2019/050037, filed Jan. 8, 2019, which claims priority from GB Patent Application No. 1801143.7, filed Jan. 24, 2018, each of which is hereby fully incorporated herein by reference.

FIELD

The present disclosure relates to vapor provision systems such as nicotine delivery systems (e.g. electronic cigarettes and the like) and apparatus for vapor provision systems.

BACKGROUND

Electronic vapor provision systems such as electronic cigarettes (e-cigarettes) generally contain a vapor precursor material, such as a reservoir of a source liquid containing a formulation, typically including nicotine, from which a vapor is generated for inhalation by a user, for example through heat vaporization. Thus, a vapor provision system will typically comprise a vapor generation chamber containing a vaporizer, e.g. a heating element, arranged to vaporize a portion of precursor material to generate a vapor in the vapor generation chamber. As a user inhales on the device and electrical power is supplied to the vaporizer, air is drawn into the device through an inlet hole and along an inlet air channel connecting to the vapor generation chamber where the air mixes with vaporized precursor material to form a condensation aerosol. There is an outlet air channel connecting from the vapor generation chamber to an outlet in the mouthpiece and the air drawn into the vapor generation chamber as a user inhales on the mouthpiece continues along the outlet flow path to the mouthpiece outlet, carrying the vapor with it, for inhalation by the user. Some electronic cigarettes may also include a flavor element in the air flow path through the device to impart additional flavors. Such devices may sometimes be referred to as hybrid devices, and the flavor element may, for example, include a portion of tobacco arranged in the air flow path between the vapor generation chamber and the mouthpiece such that vapor/condensation aerosol drawn through the device passes through the portion of tobacco before exiting the mouthpiece for user inhalation.

For electronic cigarettes using a liquid vapor precursor (e-liquid) there is a risk of the liquid leaking. This is the case for non-hybrid electronic cigarettes and for hybrid devices. Liquid-based e-cigarettes will typically have a capillary wick for transporting liquid from within a liquid reservoir to a vaporizer located in the air channel connecting from the air inlet to the vapor outlet for the e-cigarette. Thus the wick typically passes through an opening in a wall that separates the liquid reservoir from the air channel in the vicinity of the vaporizer.

FIG. 1 schematically shows a cross-section of a portion of an electronic cigarette in the vicinity of its vapor generation chamber 2, i.e. the region where vapor is generated during use. The electronic cigarette comprises a central air channel 4 through a surrounding annular liquid reservoir 6. The annular liquid reservoir 6 is defined by an inner wall 8 and an outer wall 10, which may both be cylindrical (the inner wall 8 separates the liquid reservoir 6 from the air channel, and so in that sense the inner wall 8 also defines the air channel). The electronic cigarette comprises a vaporizer 12 in the form of a resistive heating coil. The coil 12 is wrapped around a capillary wick 14. Each end of the capillary wick 14 extends into the liquid reservoir 6 through an opening 16 in the inner wall 8. The wick 14 is thus arranged to convey liquid from within the liquid reservoir 6 to the vicinity of the coil 12 by capillary action. During use an electric current is passed through the coil 12 so that it is heated and vaporizes a portion of liquid from the capillary wick 14 adjacent the coil 12 to generate vapor in the vapor generation chamber 2 for user inhalation. The vaporized liquid is then replaced by more liquid being drawn along the wick 14 from the liquid reservoir 6 by capillary action.

Because the reservoir inner wall 8 has openings 16 to allow liquid to be drawn out of the reservoir 6 to the vaporizer 12, there is a corresponding risk of leakage from this part of the electronic cigarette. Leakage is undesirable both from the perspective of the end user naturally not wanting to get the e-liquid on their hands or other items, and also from a reliability perspective, since leakage has the potential to damage the electronic cigarette itself, for example due to corrosion of components which are not intended to come into contact with the liquid.

Various approaches are described herein which seek to help address or mitigate at least some of the issues discussed above.

SUMMARY

According to a first aspect of certain embodiments there is provided vapor provision apparatus comprising: a reservoir housing defining a reservoir for liquid; a liquid transport element for transporting liquid from the reservoir to a vaporizer for vaporization; and a channel for the liquid transport element, wherein the channel has a sidewall at least partly defined by a section of the reservoir housing; wherein the liquid transport element comprises a first portion arranged to deliver liquid to the vaporizer and a second portion arranged to extend along the channel, wherein the channel has a cross-section that corresponds with (i.e. matches) the cross-section of the second portion of the liquid transport element, and wherein the section of the reservoir housing that defines the sidewall of the channel has one or more openings to provide fluid communication between the liquid transport element in the channel and liquid in the reservoir.

According to another aspect of certain embodiments there is provided a vapor provision system comprising the vapor provision apparatus of the first aspect and a control unit comprising a power supply and control circuitry configured to selectively supply power from the power supply to the vaporizer.

According to another aspect of certain embodiments there is provided vapor provision means comprising: reservoir housing means defining reservoir means for liquid; liquid transport means for transporting liquid from the reservoir means to vaporizer means for vaporization; and channel means for the liquid transport means, wherein the channel means has sidewall means at least partly defined by a section of the reservoir housing means; wherein the liquid transport means comprises a first portion arranged to deliver liquid to the vaporizer means and a second portion arranged to extend along the channel means, wherein the channel means has a cross-section that matches (corresponds with) the cross-section of the second portion of the liquid transport means, and wherein the section of the reservoir housing means that defines the sidewall means of the channel means has one or more through hole means to provide fluid communication between the liquid transport means in the channel means and liquid in the reservoir means.

According to another aspect of certain embodiments there is provided a method of forming vapor provision apparatus comprising: providing a reservoir housing defining a reservoir for liquid, providing a liquid transport element for transporting liquid from the reservoir to a vaporizer for vaporization; providing a channel for the liquid transport element, wherein the channel has a sidewall at least partly defined by a section of the reservoir housing; and arranging a first portion of the liquid transport element to deliver liquid to the vaporizer and a second portion of the liquid transport element to extend along the channel, wherein the channel has a cross-section that corresponds with the cross-section of the second portion of the liquid transport element, and wherein the section of the reservoir housing that defines the sidewall of the channel has one or more openings to provide fluid communication between the liquid transport element in the channel and liquid in the reservoir.

According to another aspect of certain embodiments there is provided a component for a vapor provision apparatus having a liquid reservoir defined by a reservoir housing, wherein the component comprises: an insert configured to attach to the reservoir housing so as to cooperate with a section of the reservoir housing to form a channel having a side wall defined by the section of the reservoir housing and the insert; and a liquid transport element for transporting liquid from the reservoir to a vaporizer for vaporization, wherein the liquid transport element comprises a first portion arranged to deliver liquid to the vaporizer and a second portion extending along the channel, wherein the channel has a cross-section that corresponds with the cross-section of the second portion of the liquid transport element in the channel, and wherein the section of the reservoir housing that defines the sidewall of the channel has one or more openings to provide fluid communication between the liquid transport element in the channel and liquid in the reservoir.

It will be appreciated that features and aspects of the disclosure described herein in relation to the first and other aspects of the disclosure are equally applicable to, and may be combined with, embodiments of the disclosure according to other aspects of the disclosure as appropriate, and not just in the specific combinations described above.

BRIEF DESCRIPTION OF THE DRAWINGS

Embodiments of the disclosure will now be described, by way of example only, with reference to the accompanying drawings, in which.

DETAILED DESCRIPTION

Figure 1:
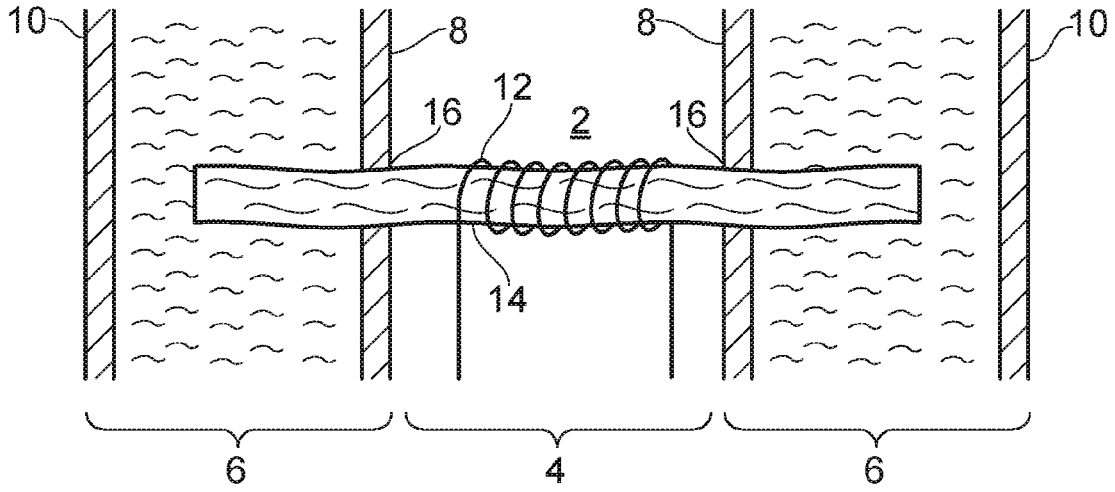
PRIOR ART FIG. 1
FIG. 1 represents a schematic cross-sectional cut-away view of a vapor generation region of a previously proposed vapor provision system.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems and component parts of vapor provision systems. Vapor provision systems may also be referred to as aerosol provision systems, such as e-cigarettes, and include hybrid systems (electronic cigarettes including tobacco or another flavor element separate from the vapor generation region). Throughout the following description the term "e-cigarette" or "electronic cigarette" may sometimes be used, but it will be appreciated this term may be used interchangeably with vapor provision system/device/apparatus. Furthermore, and as is common in the technical field, the terms "vapor" and "aerosol", and related terms such as "vaporize", "volatilize" and "aerosolize", may generally be used interchangeably.

Vapor provision systems (e-cigarettes) often, though not always, comprise a modular assembly including both a reusable part (control unit part) and a replaceable (disposable) cartridge part, which is sometimes also referred to as a cartomizer. Often the replaceable cartridge part will comprise the vapor precursor material and the vaporizer and the reusable part will comprise the power supply (e.g. rechargeable battery) and control circuitry. It will be appreciated these different parts may comprise further elements depending on functionality. For example, the reusable device part may comprise a user interface for receiving user input and displaying operating status characteristics, and the replaceable cartridge part may comprise a temperature sensor for helping to control temperature. Cartridges are electrically and mechanically coupled to a control unit for use, for example using a screw thread, latching or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Devices conforming to this type of two-part modular configuration may generally be referred to as two-part devices. It is also common for electronic cigarettes to have a generally elongate shape. For the sake of providing a concrete example, certain embodiments of the disclosure described herein will be taken to comprise this kind of generally elongate two-part device employing disposable cartridges. However, it will be appreciated the underlying principles described herein may equally be adopted for different electronic cigarette configurations, for example single-part devices or modular devices comprising more than two parts, refillable devices and single-use disposable devices, as well as devices conforming to other overall shapes, for example based on so-called box-mod high performance devices that typically have a more box-like shape. More generally, it will be appreciated certain embodiments of the disclosure are based on approaches for seeking to help reduce the likelihood of leakage in accordance with the principles described herein, and other constructional and functional aspects of electronic cigarettes implementing approaches in accordance with certain embodiments of the disclosure are not of primary significance and may, for example, be implemented in accordance with any established approaches.

Figure 2:
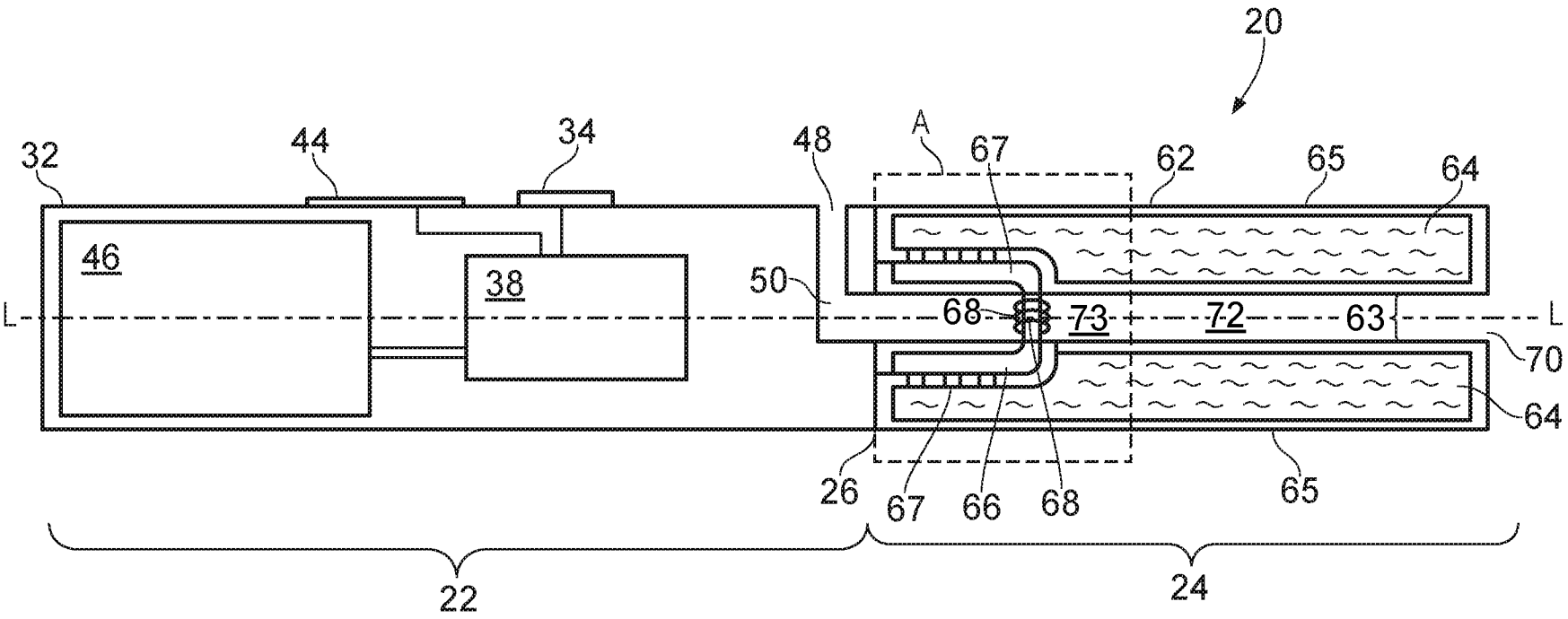
FIG. 2 represents a schematic cross-sectional cut-away view of a vapor provision system according to certain embodiments of the disclosure.
Figure 3:
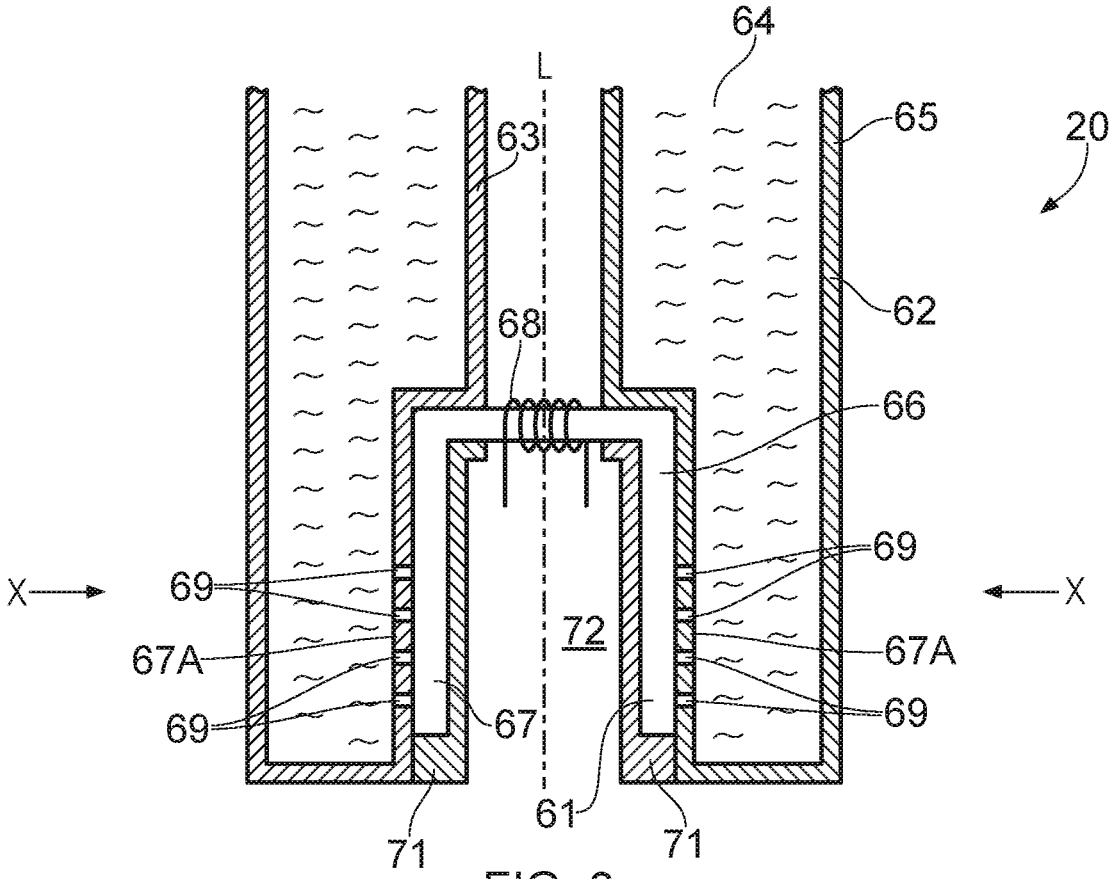
FIG. 3 represents a schematic cross-sectional cut-away view of a portion of the vapor provision system of FIG. 2.
Figure 4:
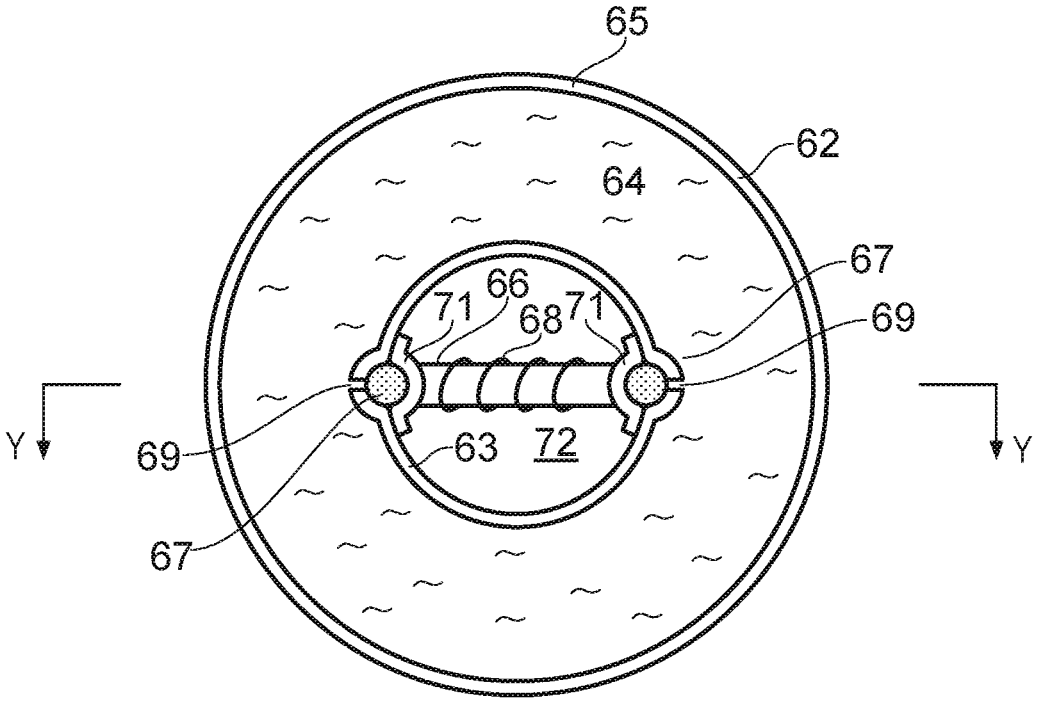
FIG. 4 represents a schematic cross-sectional cut-away view of the vapor provision system of FIG. 2 in a plane perpendicular to its longitudinal axis.

FIGS. 2 to 4 schematically represent different views of an example e-cigarette 20 in accordance with certain embodiments of the disclosure. In particular, FIG. 2 schematically represents a cut-away cross-sectional view of the e-cigarette 20 and FIG. 3 schematically represents a magnified view around a vapor generation region 73 of the e-cigarette 20 (the region indicated by the dashed box labelled A in FIG. 2). As described further below, the e-cigarette 20 includes a wick 66 and a wire heater coil 68 and the cross-sectional views of FIGS. 2 and 3 are in a plane containing the wick and a longitudinal axis L of the e-cigarette. FIG. 4 schematically represents a cut-away cross-sectional view of the e-cigarette in a plane perpendicular to the longitudinal axis of the e-cigarette at the position marked as X in FIG. 3. The view direction for FIG. 4 is from bottom-to-top for the orientation represented in FIG. 3. The cross-sectional views of FIGS. 2 and 3 are in the plane perpendicular to FIG. 4 at the position marked as Y in FIG. 4.

The e-cigarette 20 comprises two main components, namely a reusable part 22 and a replaceable/disposable cartridge part 24. In normal use the reusable part 22 and the cartridge part 24 are releasably coupled together at an interface 26. When the cartridge part is exhausted or the user simply wishes to switch to a different cartridge part, the cartridge part may be removed from the reusable part and a replacement cartridge part attached to the reusable part in its place. The interface 26 provides a structural, electrical and air path connection between the two parts and may be established in accordance with conventional techniques, for example based around a screw thread, latch mechanism, or bayonet fixing with appropriately arranged electrical contacts and openings for establishing the electrical connection and air path between the two parts as appropriate. The specific manner in which the cartridge part 24 mechanically couples to the reusable part 22 is not significant to the principles described herein, but for the sake of providing a concrete example is assumed here to comprise a latching mechanism, for example with a portion of the cartridge being received in a corresponding receptacle in the reusable part with cooperating latch engaging elements (not represented in FIGS. 2 to 4). It will also be appreciated the interface 26 in some implementations may not support an electrical and/or air path connection between the respective parts. For example, in some implementations a vaporizer may be provided in the reusable part rather than in the cartridge part, or the transfer of electrical power from the reusable part to the cartridge part may be wireless (e.g. based on electromagnetic induction), so that an electrical connection between the reusable part and the cartridge part is not needed. Furthermore, in some implementations the airflow through the electronic cigarette might not go through the reusable part so that an air path connection between the reusable part and the cartridge part is not needed.

The cartridge part 24 may in accordance with certain embodiments of the disclosure be broadly conventional apart from where modified in accordance with the approaches described herein. The cartridge part 24 comprises a reservoir housing 62 formed of a plastics material and which in this example defines the overall outer appearance of the cartridge. The reservoir housing 62 supports other components of the cartridge part and provides the mechanical interface 26 with the reusable part 22. In other examples the cartridge part 24 may further comprise a separate main housing that performs these functions with the reservoir housing mounted within the main housing. In the example of FIGS. 2 to 4 the reservoir housing 62 (and hence the overall cartridge) is generally circularly symmetric and connects to the reusable part 22 along the direction of its longitudinal axis L (i.e. its axis of longest extent/the main direction along which air flows in the cartridge during use). In this example the cartridge part has a length of around 4 cm and a diameter of around 1.8 cm. However, it will be appreciated the specific geometry, and more generally the overall shape and materials used, may be different in different implementations.

Within the reservoir housing 62 is a reservoir 64 that contains liquid vapor precursor material. The liquid vapor precursor material may be conventional, and may be referred to as e-liquid. The liquid reservoir 64 in this example has an annular shape which is generally circularly symmetric. Thus the reservoir housing 62 includes an outer wall 65 and an inner wall 63 which defines an air path 72 through the cartridge part 24. The reservoir 64 is closed at each end by end walls to contain the e-liquid. The reservoir housing 62 may be formed in accordance with conventional manufacturing techniques, for example using single- or multi-part plastics molding techniques.

The cartridge part 22 further comprises a wick (liquid transport element) 66 and a heater (vaporizer) 68. A central portion (first portion) of the wick 66 extends transversely across the cartridge air path 72 (i.e. in a direction which is substantially transverse to the longitudinal axis L of the cartridge/substantially perpendicular to the surface of the reservoir housing adjacent the central portion of the wick). Respective end portions (second and third portions) of the wick 66 are contained/enclosed in respective channels 67 which, in this example, run parallel to the direction of airflow through cartridge air path 72 (i.e. in a direction which is substantially parallel to the longitudinal axis L of the cartridge/substantially parallel to the surface of the reservoir housing adjacent the respective end portions of the wick).

As discussed further herein, in accordance with certain embodiments of the disclosure the channels 67 have a cross-section that is broadly matched (in size and shape) to the end portions of the wick such that the wick 66 fills the channels 67, for example with the wick being slightly compressed by the walls of the channels 67. For the example represented in FIG. 3, the end portions of the wick extend along the full length of the respective channels 67, but in other implementations the respective channels may be longer than the extent of the wick within them (i.e. there may be a gap between the end of the wick and the end of the channel). The ends of the respective channels adjacent the air path 72 are open to allow the wick 66 to enter the respective channels while the other ends of the respective channels are closed so that the channels enclose the respective end portions of the wick. However, in other examples these closed ends of the channel may instead be open to the liquid reservoir 64, and indeed in some such implementations the end portions of the wick may extend along the entire length of the respective channels and project into the liquid reservoir itself.

In accordance with certain embodiments of the disclosure each channel has a wall 67A that is defined by a section of the reservoir housing 62. For the example of FIGS. 2 to 4 this section of the reservoir housing 62 is a section of the inner wall 63 of the reservoir housing 62 such that the respective channels 67A are located between the air flow path 72 and the reservoir 64. For each channel 67, the wall 67A is provided by a section of the reservoir housing 62 that is parallel to the axis of extent of the wick adjacent to the wall, and in that sense the walls 67A may be referred to as side walls 67A for the channels 67 (e.g. as opposed to the end walls for the channels which are perpendicular to the axis of extent of the wick). The side walls 67A provided by the reservoir housing include openings (through holes) 69 providing fluid communication between the interior of the reservoir 64 and the channels 67, thereby allowing liquid from within the reservoir to be absorbed by the end portions of the wick 66 within the respective channels 67. Liquid absorbed in the end portions of the wick may then be transported to the central portion of the wick within the air flow path 72 for delivery to the heater 68 for vaporization to generate a vapor for user inhalation. In this example the plurality of through holes (openings) 69 comprises a series of broadly circular openings, whereas in other examples the plurality of through openings may instead or in addition comprise one or more slotted openings. The total cross-sectional area of the openings may be selected having regard to the desired rate at which liquid is to be drawn from the reservoir during use, having regard to factors which impact the rate at which liquid may be drawn through the openings, such as viscosity. For example, an implementation supporting relatively high rates of vaporization (e.g. a relatively high power device) and/or a relatively viscous liquid may benefit from a relatively large integrated cross-sectional area for the openings to help ensure liquid can be absorbed by the wick through the openings at a suitable rate to replenish liquid vaporized from the wick during use. Conversely, an implementation supporting relatively low rates of vaporization or a relatively low viscosity liquid may have a relatively small integrated cross-sectional area for the openings. For any given implementation, an appropriate configuration of openings to feed liquid to the side surface of the wick in accordance with the principles described herein may, for example, be determined empirically during a design phase.

In this example implementation each channel 67 has a generally circular cross-section (in other examples the channels may have a non-circular cross-section) and comprises an initial short section that extends in a direction perpendicular to the longitudinal axis of the e-cigarette (i.e. extending away from the air flow path 72 in a sideways direction for the orientation shown in FIG. 3) and a longer main section that extends in a direction that is parallel to the longitudinal axis of the e-cigarette (i.e. extending parallel to the air flow path 72 in a vertical direction for the orientation shown in FIG. 3). That is to say, in this example, the respective channels 67 each include a change in direction, but the main part of the respective channels is aligned parallel to the longitudinal axis of the cartridge 20. In that sense the channels (and the portions of the wick within the channels) may be considered for this configuration to extend parallel to the air path through the cartridge, despite there being a short initial section of the channels which does not extend parallel to the air path. For the example represented in FIGS. 2 to 4, the change in direction of the channels is shown as a relatively sharp turn, but a more rounded turn could be used.

The central portion of the wick 66 and the heater 68 are arranged in the cartridge air path 72 such that a region of the cartridge air path 72 around the wick 66 and heater 68 in effect defines a vaporization region 73 for the cartridge part. E-liquid in the reservoir 64 infiltrates the wick 66 through the openings 69 in the side walls 67A of the respective channels and is drawn along the wick (i.e. along the channels 67) by surface tension/capillary action (i.e. wicking). The heater 68 in this example comprises an electrically resistive wire coiled around the wick 66. In this example the heater 68 comprises a nickel chrome alloy (Cr20Ni80) wire and the wick 66 comprises a glass fiber bundle, but it will be appreciated the specific heater configuration and wick material is not of primary significance to the principles described herein. For example, in some implementations the wick may comprise a plurality of fibers of a different material, for example cotton, or may comprise a non-fibrous material, for example the wick may be formed of a porous ceramic. In use, electrical power may be supplied to the heater 68 via electrical leads (not shown for simplicity) to vaporize an amount of e-liquid (vapor precursor material) delivered to the heater 68 by the portion of the wick 66 adjacent the heater 68. Vaporized e-liquid may then become entrained in air drawn along the cartridge air path 72 from the vaporization region 73 towards a mouthpiece outlet 70 for user inhalation.

The rate at which e-liquid is vaporized by the vaporizer (heater) 68 will generally depend on the amount (level) of power supplied to the heater 68. Thus, electrical power can be applied to the heater 66 to selectively generate vapor from the e-liquid in the cartridge part 24, and furthermore, the rate of vapor generation can be changed by changing the amount of power supplied to the heater 68, for example, through pulse width and/or frequency modulation techniques.

The reusable part 22 may be conventional and comprises an outer housing 32 with an opening that defines an air inlet 48 for the e-cigarette, a battery 46 for providing operating power for the electronic cigarette, control circuitry 38 for controlling and monitoring the operation of the electronic cigarette, a user input button 34 and a visual display 44.

The outer housing 32 may be formed, for example, from a plastics or metallic material and in this example has a circular cross-section generally conforming to the shape and size of the cartridge part 24 so as to provide a smooth transition between the two parts at the interface 26. In this example, the reusable part has a length of around 8 cm so the overall length of the e-cigarette when the cartridge part and reusable part are coupled together is around 12 cm. However, and as already noted, it will be appreciated that the overall shape and scale of an electronic cigarette implementing an embodiment of the disclosure is not significant to the principles described herein.

The air inlet 48 connects to an air path 50 through the reusable part 22. The reusable part air path 50 in turn connects to the cartridge air path 72 across the interface 26 when the reusable part 22 and cartridge part 24 are connected together. Thus, when a user inhales on the mouthpiece opening 70, air is drawn in through the air inlet 48, along the reusable part air path 50, across the interface 26, through the vapor generation region in the vapor generation region 73 in the vicinity of the atomizer 68 (where vaporized e-liquid becomes entrained in the air flow), along the cartridge air path 72, and out through the mouthpiece opening 70 for user inhalation.

The battery 46 in this example is rechargeable and may be of a conventional type, for example of the kind normally used in electronic cigarettes and other applications requiring provision of relatively high currents over relatively short periods. The battery 46 may be recharged through a charging connector in the reusable part housing 32, for example a USB connector (not shown).

The user input button 34 in this example is a conventional mechanical button, for example comprising a spring-mounted component which may be pressed by a user to establish an electrical contact. In this regard, the input button may be considered an input device for detecting user input and the specific manner in which the button is implemented is not significant. For example, other forms of mechanical button(s) or touch-sensitive button(s) (e.g. based on capacitive or optical sensing techniques) may be used in other implementations.

The display 44 is provided to provide a user with a visual indication of various characteristics associated with the electronic cigarette, for example current power setting information, remaining battery power, and so forth. The display may be implemented in various ways. In this example the display 44 comprises a conventional pixilated LCD screen that may be driven to display the desired information in accordance with conventional techniques. In other implementations, the display may comprise one or more discrete indicators, for example LEDs, that are arranged to display the desired information, for example through particular colors and/or flash sequences. More generally, the manner in which the display is provided and information is displayed to a user using the display is not significant to the principles described herein. For example, some embodiments may not include a visual display and may include other means for providing a user with information relating to operating characteristics of the electronic cigarette, for example using audio signaling or haptic feedback, or may not include any means for providing a user with information relating to operating characteristics of the electronic cigarette.

The control circuitry 38 is suitably configured/programmed to control the operation of the electronic cigarette to provide functionality in accordance with the established techniques for operating electronic cigarettes. For example, the control circuitry 38 may be configured to control a supply of power from the battery 46 to the heater/vaporizer 68 to generate vapor from a portion of the e-liquid in the cartridge part 24 for user inhalation via the mouthpiece outlet 70 in response to user activation of the input button 34, or in other implementations in response to other triggers, for example in response to detecting user inhalation. As is conventional, the control circuitry (processor circuitry) 38 may be considered to logically comprise various sub-units/circuitry elements associated with different aspects of the electronic cigarette's operation, for example user input detection, power supply control, display driving, and so on. It will be appreciated the functionality of the control circuitry 38 can be provided in various different ways, for example using one or more suitably programmed programmable computer(s) and/or one or more suitably configured application-specific integrated circuit(s)/circuitry/chip(s)/chipset(s) configured to provide the desired functionality.

As will be understood from the above discussion, a significance difference between the vapor provision system/electronic cigarette represented in FIGS. 2 to 4 and previously proposed electronic cigarettes is the manner in which the liquid transport element/wick 66 is arranged to receive liquid from the reservoir 64 for vaporization. In particular, in accordance with certain embodiments of the disclosure, respective portions of the liquid transport element 66 pass into and along respective channels 67 that run along a wall of the reservoir housing 62, with openings in the wall of the reservoir housing between the channels 67 and the reservoir 64 providing for fluid communication between the wick and liquid in the reservoir. Furthermore, the channels are matched in cross-section to the portions of the wick within the channel. The inventors have recognized that enclosing a wick in a channel in this way can help reduce the risk of liquid escaping from the reservoir (leakage) while at the same time allowing liquid to be supplied to the wick through the side walls of the respective channels via the openings in these walls.

Thus in the example of FIGS. 2 to 4 a side wall defining each channel is at least partly defined by a section of the reservoir housing. In this example the side wall of each channel is further defined by an insert 71 attached to the reservoir housing to encompass the second portion of the liquid transport element to form the channel. Thus, as can be seen in FIG. 4, the respective channels are formed by the space between a section of the inner wall 63 of the reservoir housing 62 which is slightly recessed into the reservoir to accommodate one side of the wick and a correspondingly aligned insert having a profile that projects slightly into the air flow path to accommodate the other side of the wick. The insert 71 includes flanged sections around the channel to facilitate sealing and attachment of inserts to the reservoir housing. The inserts 71 also define the closed ends of the respective channels where they are again sealed against the reservoir housing to form the channels in a blind-hole configuration. The cross-section of FIG. 4 is taken in a plane which passes through openings 69 for each of the channels, thereby showing how liquid in the reservoir 64 is fed to the end portions of the wick 66 within the respective channels 67.

During assembly the respective inserts maybe attached to the reservoir housing, for example using glue or ultrasonic welding, and the ends of the wick may then be threaded into respective channels 67. However, in practice it may be simpler for the ends of the wick to be appropriately located relative to one or other of the reservoir housing or the inserts before the inserts are attached to the reservoir housing to in effect clamp the wick between the inserts and reservoir housing during manufacture. However, it will be appreciated the specific manner in which the channels 67 are formed and the manner in which the wick is assembled into the channels 67 is not of primary significance to the principles described herein.

As schematically represented in FIGS. 2 to 4, in accordance with certain embodiments of the disclosure the cross-sectional area of the channels 67 is matched to the cross-sectional area of the wick within the channels. By this it is meant the wick substantially fills the volume of the channel over the length along which the wick extends in the channel. Thus, a major part of the outer surface of the wick within the channel may be in contact with/adjacent to the side walls defining the channel. In this regard the wick may be considered to be in contact with/adjacent to the walls defining the channel if a gap between the wick and the channel walls is too small to allow bulk liquid flow (i.e. non-capillary flow) because of surface tension effects in this region. In some examples the cross-sectional area of each channel may be broadly consistent along its length, and may be slightly less than the uncompressed cross-sectional area of the portions of the wick in the channels so that the wick is compressed by the channel side walls. For example, in accordance with certain embodiments of the disclosure the wick may be compressed in the channels by such an amount that its cross-sectional area is reduced compared to its uncompressed cross-sectional area outside the channels by an amount of at least around 5%, for example at least around 10%, for example at least around 15%, for example at least around 20%, for example at least around 25%, for example at least around 30%. More generally, the amount of compression may be different in different implementations. For example, in some cases there may be no compression such that the cross-section of the channels 67 is the same size and shape as the nominal cross-section for the wick, whereas in other cases there may be more than 30% areal compression. The amount of compression may be selected to establish an appropriate compromise between helping to ensure there is a desired degree of sealing between the outer surface of the wick and the inner wall of the channels without unduly restricting fluid flow along the length of the wick. An appropriate degree of compression may, for example, be determined through empirical testing.

The inventors have found the likelihood of leakage can be reduced further for each channel if the distance between the end of the channel 67 that opens to the air flow path 72 and the nearest opening 69 in the side wall to the reservoir 64 is relatively long compared with a characteristic diameter (width) of channel. For example, in accordance with certain embodiments this distance may be greater than a characteristic diameter (width) of the channel by a factor of at least around 2, for example at least around 2.5, for example at least around 3, for example at least around 3.5, for example at least around 4, for example at least around 4.5, for example at least around 5. In terms of absolute length, in accordance with certain embodiments of the disclosure the distance may be at least around 3 mm, for example at least around 4 mm, for example at least around 5 mm, for example at least around 6 mm, for example at least around 7 mm, for example at least around 8 mm.

It will be appreciated the wick and/or channel may not have a strictly circular cross-section, and in that regard, references herein to the diameter/width of the wick or channel may be taken to correspond to the diameter of a circle having the same cross-sectional area as the wick or channel in a plane perpendicular to its axis of extent (i.e. so the characteristic diameter/width=2*sqrt(cross-sectional area/pi)). It will also be appreciated the characteristic diameter, particularly for the wick material, may vary to some extent along the length of the wick/channel, and in that sense the characteristic diameter/width may be considered to be a length-averaged characteristic diameter (e.g. averaged over a length that is greater than the expected scale of typical variations in diameter, for example over several millimeters to a centimeter or so). Thus, while the terms diameter and width may be used herein for the wick and channels for simplicity, it will be appreciated this should be interpreted as a reference to a length-averaged characteristic diameter, for example, a diameter corresponding to that of a circle having the same length-averaged cross-sectional area as the wick or channel.

In terms of the overall length of the portions of the wick material in the channels, a length of the end portion of the wick in each channel may be relatively long, for example greater than an amount selected from the group comprising at least around 6 mm, for example at least around 8 mm, for example at least around 10 mm, for example at least around 12 mm, for example at least around 14 mm, for example at least around 16 mm.

The example distances and lengths for the channels set out above may, for example, be appropriate for use with a wick having a diameter within the respective channels of between around 1 mm and around 3 mm, for example between around 1.2 mm and around 2.8 mm, for example between around 1.4 mm and around 2.6 mm, for example between around 1.5 mm and around 2.5 mm, for example between around 1.7 mm and around 2.3 mm.

For the sake of providing a concrete example, it is assumed for the implementation represented in FIGS. 2 to 4 that the wick has a nominal uncompressed diameter of 2 mm and each channel has a length of around 10 mm and an inner diameter of around 1.8 mm (i.e. so the cross-section of the wick is compressed in the channel by around 20%). In examples in which a channel is not straight, for example as in FIGS. 2 to 4, the channel length may be measured along its centerline. The width of the air channel 72 traversed by the wick in this example is around 5 mm and the respective ends of the wick extend into the channels by around 10 mm (i.e. so that in this example the ends of the wick reach the ends of the channels).

However, it will be appreciated the specific geometry for the wick may vary for different implementations. For example, in a relatively high power electronic cigarette that is able to generate a relatively large amount of vapor, a larger wick, and correspondingly larger channels, may be used to help maintain a sufficient supply of liquid to the vaporizer. Conversely, in a relatively low power electronic cigarette that generates a relatively small amount of vapor, a smaller wick, and correspondingly smaller channels, may be considered more appropriate.

Figure 5:
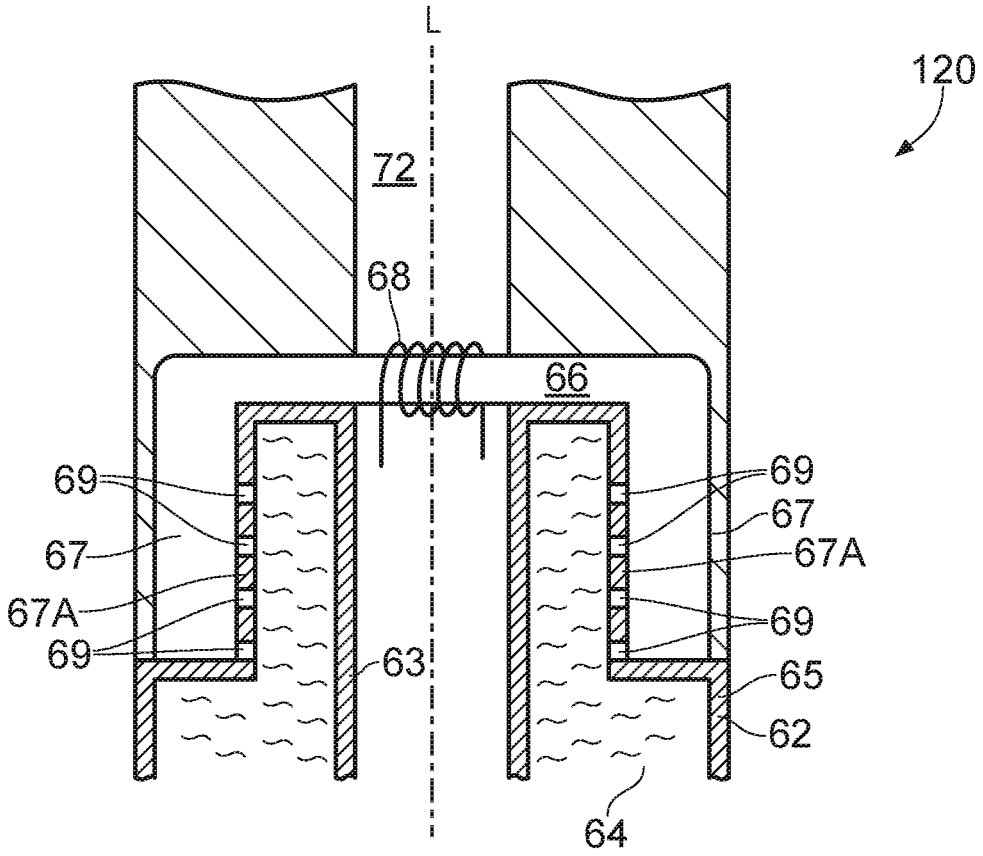
FIG. 5 represents a schematic cross-sectional cut-away view of a vapor provision system according to certain other embodiments of the disclosure.

FIG. 5 schematically shows a cross-section of a portion of the electronic cigarette/vapor provision system 120 in the vicinity of its vapor generation chamber in accordance with another example embodiment. Various aspects of the electronic cigarette 120 represented in FIG. 5 are similar to, and will be understood from, corresponding aspects of the electronic cigarette 20 represented in FIGS. 2 to 4 with functionally corresponding features identified by the same reference numerals. However, the example of FIG. 5 differs from the example of FIGS. 2 to 4 in terms of its overall configuration. In particular, whereas the channels 67 in the example of FIG. 3 are formed between the air flow path 72 and the liquid reservoir 64, in the example of FIG. 5, the reservoir 64 again has an annular configuration, but in this example the channels 67 are arranged to run along the outer wall of the reservoir. Consequently, the section of the reservoir housing 62 containing the openings 69 for feeding liquid to the wick 66 within the respective channels 67 are on the outer wall of the generally annular reservoir. Despite this difference in overall construction, it will be appreciated the principles described above in respect of how the end portions of the wick are encompassed in a channel having a side wall at least partly defined by a section of the reservoir housing with holes for providing fluid communication between the wick and the reservoir apply in a corresponding way. That is to say, despite the channels being provided in a different manner in FIG. 5 as compared with the examples of FIGS. 2 to 4, the underlying principles of operation, for example in terms of helping to reduce leakage, are the same as for the other examples described herein.

It will be appreciated there are other ways in which channels may be provided in other implementations in accordance with other example elements of the disclosure. For example, whereas in the examples of FIGS. 2 to 6 the main sections of the channels are straight, in other examples they may be bent or curved, for example to follow a helical or undulating path to allow for a longer effective length over a given length along the longitudinal axis of the e-cigarette. More generally, it will be appreciated that the specific manner in which the channels are formed is not significant to the principle of passing a wick through a channel formed adjacent a wall of a reservoir with one or more openings in the wall of the reservoir for feeding liquid to the sides of end portions of the wick as described herein.

While the above-described embodiments have in some respects focused on some specific example vapor provision systems, it will be appreciated the same principles can be applied for vapor provision systems using other technologies. That is to say, the specific manner in which various aspects of the vapor provision system function are not directly relevant to the principles underlying the examples described herein.

For example, while various example configurations have been discussed above, it will be appreciated the specific manner in which the channels are formed is not of primary significance to the principles described herein, and channels through which the wick extends from the vapor generation region may be provided differently in different implementations. Furthermore, it will be appreciated that whereas in the examples described herein the wick is assumed to have both ends extending into respective channels, it will be appreciated the same principles may be applied in respect of a wick having only one end extending into a channel (i.e. single-ended liquid feeding), or indeed a wick having multiple arms (e.g. a cross-like form) with more than two ends extending into corresponding channels.

Furthermore, whereas the above-described embodiments have primarily focused on aerosol provision systems comprising a vaporizer comprising a resistance heater coil, in other examples the vaporizer may comprise other forms of heater, for example a planar heater, in contact with a liquid transport element. Furthermore, in other implementations a heater-based vaporized might be inductively heated. In yet other examples, the principles described above may be adopted in devices which do not use heating to generate vapor, but use other vaporization technologies, for example piezoelectric excitement.

Furthermore still, and as already noted, whereas the above-described embodiments have focused on approaches in which the aerosol provision system comprises a two-part device, the same principles may be applied in respect of other forms of aerosol provision system which do not rely on replaceable cartridges, for example refillable or one-time use devices.

More generally, apart from the modifications associated with the introduction of the above-described channel configurations for the liquid transport element, it will be appreciated electronic cigarettes in accordance with certain embodiments of the disclosure may be otherwise conventional, both in terms of structural configuration and functional operation.

Thus there has been described a vapor provision apparatus comprising: a reservoir housing defining a reservoir for liquid; a liquid transport element for transporting liquid from the reservoir to a vaporizer for vaporization; and a channel for the liquid transport element, wherein the channel has a sidewall at least partly defined by a section of the reservoir housing; wherein the liquid transport element comprises a first portion arranged to deliver liquid to the vaporizer and a second portion arranged to extend along the channel, wherein the channel has a cross-section that matches/corresponds with the cross-section of the second portion of the liquid transport element, and wherein the section of the reservoir housing that defines the sidewall of the channel has one or more openings to provide fluid communication between the liquid transport element in the channel and liquid in the reservoir.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A vapor provision apparatus comprising:

a reservoir housing defining a reservoir for a liquid;

a liquid transport element for transporting the liquid from the reservoir to a vaporizer for vaporization; and a channel for the liquid transport element, wherein the channel has a sidewall at least partly defined by a section of the reservoir housing;

wherein the liquid transport element comprises a first portion arranged to deliver the liquid to the vaporizer and a second portion extending along the channel, wherein the channel has a cross-section that corresponds with a cross-section of the second portion of the liquid transport element in the channel, and wherein the section of the reservoir housing that at least partly defines the sidewall of the channel has one or more openings to provide fluid communication between the liquid transport element in the channel and the liquid in the reservoir.

2. The vapor provision apparatus of claim 1, wherein at least one of:

the second portion of the liquid transport element extends in a direction which is substantially parallel to a longitudinal axis of the vapor provision apparatus, the first portion of the liquid transport element extends in a direction which is substantially transverse to a longitudinal axis of the vapor provision apparatus, the second portion of the liquid transport element extends in a direction which is substantially parallel to a surface of the reservoir housing adjacent to the second portion of the liquid transport element, or the first portion of the liquid transport element extends in a direction which is substantially perpendicular to a surface of the reservoir housing adjacent to the second portion of the liquid transport element.

3. The vapor provision apparatus of claim 1, wherein the reservoir has an annular configuration and is arranged around an air flow path through the vapor provision apparatus, and wherein:

the channel for the liquid transport element is arranged between the reservoir and the air flow path, or the reservoir is arranged between the liquid transport element and the air flow path.

4. The vapor provision apparatus of claim 1, wherein the side wall for the channel is further defined by an insert attached to the reservoir housing around the second portion of the liquid transport element.

5. The vapor provision apparatus of claim 1, wherein:

a distance along the channel from where the liquid transport element enters the channel to a nearest opening is greater than the width of the channel by a factor selected from the group comprising: at least 2, at least 2.5, at least 3, at least 3.5; at least 4; at least 4.5; and at least 5, or a distance along the channel from where the liquid transport element enters the channel to the nearest opening is greater than an amount selected from the group comprising: at least 3 mm; at least 4 mm; at least 5 mm; at least 6 mm; at least 7 mm; and at least 8 mm.

6. The vapor provision apparatus of claim 1, wherein a length of the second portion of the liquid transport element in the channel is greater than an amount selected from the group comprising: at least 6 mm; at least 8 mm; at least 10 mm; at least 12 mm; at least 14 mm; and at least 16 mm.

7. The vapor provision apparatus of claim 1, wherein the second portion of the liquid transport element in the channel has a width selected from the group comprising: between 1 mm and 3 mm; between 1.2 mm and 2.8 mm; between 1.4 mm and 2.6 mm; between 1.5 mm and 2.5 mm; and between 1.7 mm and 2.3 mm.

8. The vapor provision apparatus of claim 1, wherein the second portion of the liquid transport element is compressed by the channel.

9. The vapor provision apparatus of claim 1, wherein the second portion of the liquid transport element is compressed by the channel such that a cross-sectional area of the second portion liquid transport element is reduced compared to an uncompressed cross-sectional area of the first portion of the liquid transport element outside the channel by an amount selected from the group comprising: at least 5%; at least 10%; at least 15%; at least 20%; at least 25%; and at least 30%.

10. The vapor provision apparatus of claim 1, wherein the vaporizer comprises a heating coil wound around the liquid transport element.

11. The vapor provision apparatus of claim 1, further comprising at least one of the vaporizer or the liquid.

12. The vapor provision apparatus of claim 1, wherein the vapor provision apparatus is a cartridge configured to be coupled to a control unit for use.

13. A vapor provision system comprising the vapor provision apparatus of claim 1 and a control unit comprising a power supply and control circuitry configured to selectively supply power from the power supply to the vaporizer.

14. The vapor provision apparatus of claim 1, wherein the liquid transport element comprises a plurality of fibers.

15. The vapor provision apparatus of claim 14, wherein the plurality of fibers comprises at least one of glass fibers or cotton fibers.

16. The vapor provision apparatus of claim 1, further comprising a further channel for the liquid transport element, wherein the further channel has a sidewall at least partly defined by a further section of the reservoir housing, and wherein the liquid transport element comprises a third portion extending along the further channel, wherein the further channel has a cross-section that corresponds with a cross section of the third portion of the liquid transport element, and wherein the further section of the reservoir housing that defines the sidewall of the further channel has one or more further openings to provide fluid communication between the third portion of the liquid transport element in the further channel and the liquid in the reservoir.

17. The vapor provision apparatus of claim 16, wherein the second portion and the third portion of the liquid transport element are respective end portions of the liquid transport element on either side of the first portion of the liquid transport element.

18. A component for a vapor provision apparatus having a liquid reservoir defined by a reservoir housing, wherein the component comprises:

an insert configured to attach to the reservoir housing so as to cooperate with a section of the reservoir housing to form a channel having a side wall defined by the section of the reservoir housing and the insert; and a liquid transport element for transporting a liquid from the reservoir to a vaporizer for vaporization, wherein the liquid transport element comprises a first portion arranged to deliver the liquid to the vaporizer and a second portion extending along the channel, wherein the channel has a cross-section that corresponds with a cross section of the second portion of the liquid transport element in the channel, and wherein the section of the reservoir housing that defines the sidewall of the channel has one or more openings to provide fluid communication between the liquid transport element in the channel and the liquid in the reservoir.

19. Vapor provision means comprising:

reservoir housing means defining reservoir means for a liquid;

liquid transport means for transporting the liquid from the reservoir means to vaporizer means for vaporization; and channel means for the liquid transport means, wherein the channel means has sidewall means at least partly defined by a section of the reservoir housing means;

wherein the liquid transport means comprises a first portion arranged to deliver the liquid to the vaporizer means and a second portion extending along the channel means, wherein the channel means has a cross-section that corresponds with a cross-section of the second portion of the liquid transport means, and wherein the section of the reservoir housing means that defines the sidewall means of the channel means has one or more opening means to provide fluid communication between the liquid transport means in the channel means and the liquid in the reservoir means.

20. A method of forming vapor provision apparatus comprising:

providing a reservoir housing defining a reservoir for a liquid;

providing a liquid transport element for transporting the liquid from the reservoir to a vaporizer for vaporization;

providing a channel for the liquid transport element, wherein the channel has a sidewall at least partly defined by a section of the reservoir housing; and arranging a first portion of the liquid transport element to deliver the liquid to the vaporizer and a second portion of the liquid transport element to extend along the channel, wherein the channel has a cross-section that corresponds with a cross-section of the second portion of the liquid transport element, and wherein the section of the reservoir housing that defines the sidewall of the channel has one or more openings to provide fluid communication between the liquid transport element in the channel and the liquid in the reservoir.

* * * * *